United States Patent [19]

Yoshizuka et al.

[11] Patent Number: 4,970,549

[45] Date of Patent: Nov. 13, 1990

[54] DISPLAY DEVICE IN IMAGE FORMING APPARATUS

[75] Inventors: Ken Yoshizuka, Nagaokakyo; Takahiro Wakikaido, Yao, both of Japan

[73] Assignee: . Mita Industrial Co., Ltd., Osaka, Japan

[21] Appl. No.: 436,697

[22] Filed: Nov. 15, 1989

[30] Foreign Application Priority Data

Nov. 28, 1988 [JP] Japan ..... 63-300054

[51] Int. Cl.[5] ..... G03G 15/00

[52] U.S. Cl. ..... 355/209; 355/313

[58] Field of Search ..... 355/209, 218, 244, 313, 355/314

[56] References Cited

U.S. PATENT DOCUMENTS

| | | | |
|---|---|---|---|
| 4,393,375 | 7/1983 | Sugiura et al. | 355/209 X |
| 4,603,962 | 8/1986 | Dekura | 355/209 X |
| 4,641,954 | 2/1987 | Miyata et al. | 355/313 |
| 4,693,590 | 9/1987 | Umeda | 355/313 |
| 4,799,081 | 1/1989 | Kikuno et al. | 355/313 X |
| 4,812,877 | 3/1989 | Nishimori et al. | 355/313 X |
| 4,814,824 | 3/1989 | Ito et al. | 355/313 X |
| 4,819,029 | 4/1989 | Ito | 355/313 X |
| 4,831,414 | 5/1989 | Maruta et al. | 355/313 X |
| 4,845,526 | 7/1989 | Ito | 355/313 X |
| 4,845,527 | 7/1989 | Maruta et al. | 355/313 X |

*Primary Examiner*—R. L. Moses

*Attorney, Agent, or Firm*—Antonelli, Terry, Stout & Kraus

[57] ABSTRACT

A display device in an image forming apparatus includes a liquid crystal display panel. The display panel selectively displays two types of modes, that is, a normal mode and a special mode. In the normal mode, a copy volume, a copying magnification, a copy density and the like are displayed. In the special mode, the contents for setting edit copies, the contents for setting composite copies and the like are displayed. According to the present invention, the special mode is displayed during only a constant time period in a case where each of special mode setting keys is operated. In the other cases, the display mode is automatically switched to the normal mode. More specifically, the normal mode which a user desires to know is usually displayed on the display panel. Only when the user sets the special mode, the special mode is displayed in response to an operation of each of the special mode setting keys. Accordingly, the display device has good operability.

4 Claims, 4 Drawing Sheets

DISPLAY OF NORMAL MODE

DISPLAY OF SPECIAL MODE

DISPLAY OF SETTING OF SPECIAL MODE

DISPLAY DEVICE IN IMAGE FORMING APPARATUS

BACKGROUND OF THE INVENTION

1. Field of the Invention

The present invention relates to display devices in image forming apparatus such as electrophotographic copying apparatus and facsimiles machines.

2. Description of the Prior Art

In recent years, electrophotographic copying apparatus have been adapted to perform multiple functions, that is, to be able to make not only normal copies but also various copies such as enlarged copies and reduced copies, to edit copies such as by partial erasing and partial extraction, and to make composite copies and duplex copies.

Therefore, the conventional electrophotographic copying apparatuses performing multiple functions include, in many cases, those adapted such that there are provided, as display devices, a normal mode display device for displaying the contents necessarily required for a copying operation such as a copy volume and a copy density and a special mode display device for displaying the contents for setting the edit copies, the contents for setting the composite copies, and the like.

Furthermore, as another example the conventional electrophotographic copying apparatus include those adapted such that a single display device is used both as a normal mode display device and a special mode display device to display a necessary display mode using a display switching button.

The former electrophotographic copying apparatus in which two display devices are provided for respectively displaying the normal mode and the special mode have the disadvantages of taking much space and of being high in cost.

On the other hand, the latter electrophotographic copying apparatus in which a single display device can display both the normal mode and the special mode by switching do not have the above described disadvantages but have the disadvantage of inferior operability.

Not only the electrophotographic copying apparatus but also facsimile machines adapted to perform multiple functions have the above described disadvantages.

SUMMARY OF THE INVENTION

Therefore, a primary object of the present invention is to eliminate the above described disadvantages and to provide a display device in an image forming apparatus capable of displaying a plurality of modes by a single display device and having good operability.

Briefly stated, the present invention is directed to a display device provided in an image forming apparatus for displaying predetermined data, which comprises display means capable of selectively displaying a first mode or a second mode and usually displaying the first mode, second mode setting means for setting the second mode, operation mode setting means for setting, then the display means displays the second mode, an operation mode of the image forming apparatus based on the contents of the second mode, and automatic display switching means responsive to an output of the operation mode setting means for automatically switching the display mode of the display means from the second mode to the first mode.

Thus, according to the present invention, in a case where the display means displays the second mode, if the operation mode of the image forming apparatus is set based on the contents of the second mode, the display mode is then automatically switched to the first mode. More specifically, according to the present invention, the contents displayed in the display device can be automatically switched to the contents which a user desires to know. In particular, a particular mode is set and displayed and, then, the display mode is automatically switched to a general mode indicative of an operating state of the device. Accordingly, there can be provided a display device convenient for a user.

The foregoing and other objects, features, aspects and advantages of the present invention will become more apparent from the following detailed description of the present invention then taken in conjunction with the accompanying drawings.

DESCRIPTION OF THE PREFERRED EMBODIMENTS

Figure 1:
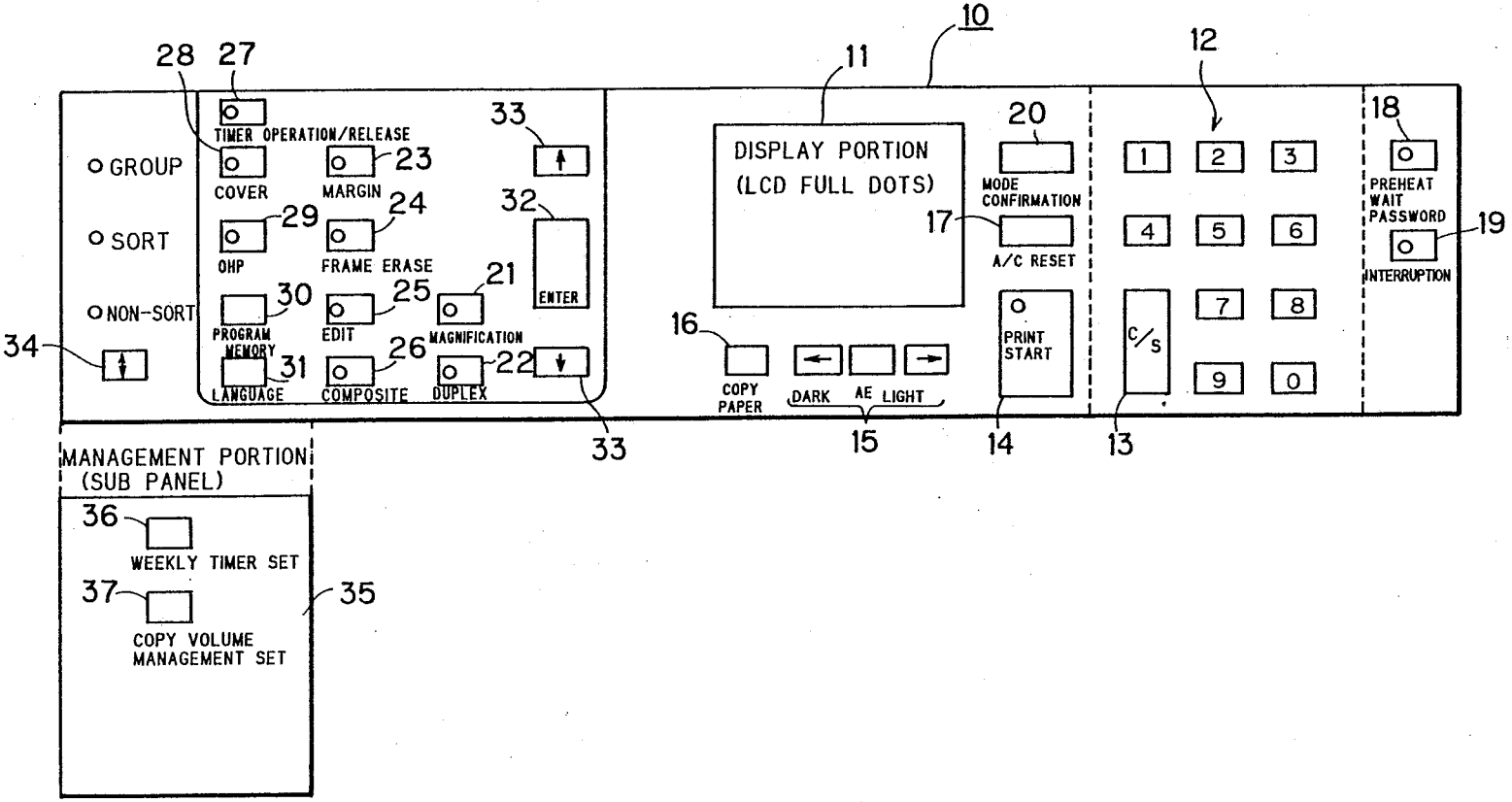
FIG. 1 is a plan view illustrating an operation panel of an electrophotographic copying apparatus according to an embodiment of the present invention.

FIG. 1 is a plan view illustrating an operation panel 10 of an electrophotographic copying apparatus according to an embodiment of the present invention. The operation panel 10 is provided with a display portion 11. A liquid crystal display panel having a plurality of dots arranged in a longitudinal and lateral matrix is employed as this display portion 11. Arbitrary dots enter the displayed state in response to an applied signal, so that data is displayed in the liquid crystal display panel. A portion where data is displayed in the operation panel 10 is only this display portion 11.

On the operation panel 10, there are further arranged a ten-key 12 for entering numeric data such as a copy volume, a clear/stop key 13 operated when the numeric data erroneously entered by the ten-key 12 is cleared and when it is desired to stop a copying operation in the course thereof, a print start key 14 for indicating the start of the copying operation, a copy density setting key 15 for setting a copy density, a copy paper selection key 16 for selecting the size of the copy paper, an all clear key 17 for clearing all data set in the electrophotographic copying apparatus, a preheat key 18 for switching the electrophotographic copying apparatus between the preheat state and the standby state, and an interruption key 19 used in interruption copy. In addition, a mode confirmation key 20 for switching the contents displayed in the display portion 11 to confirm a set mode is provided on the operation panel 10. The mode confirmation key 20 is used for switching the contents displayed in the display portion 11 to the special mode in only a time period during which it is depressed.

Various keys for setting the special mode are arranged on the operation panel 10. More specifically, there are arranged a magnification setting key 21, a duplex copy setting key 22, a margin setting key 23, a frame erase instruction key 24, an edit key 25 for setting edit copies, a composite copy setting key 26, a timer operation/release key 27, a cover copy setting key 28 operated when it is desired to change the color of only the first copy sheet in making a plurality of copies, an OHP copy setting key 29 operated when copies are made on a film for an overhead projector, a program memory key 30, a language switching key 31 for switching a display language in the display portion 11, a setting end key 32, and an indication key 33. A special copy mode can be set by the various special mode setting keys. The contents of the special mode set are displayed in the display portion 11 when each of the special mode setting keys is operated.

The special mode setting keys may be always exposed on the operation panel 10. Alternatively, the special mode setting keys may be usually covered with, for example, a transparent cover and the cover may be opened in using the special mode setting keys in consideration of the low frequency of use.

Additionally, a sorter switching key 34 for controlling a sorter portion connected to the electrophotographic copying apparatus is provided on the operation panel 10.

The electrophotographic copying apparatus further comprises a sub panel 35 in addition to the operation panel 10. This sub panel 38 is provided in a place which a user does not usually touch, for example, inside of a front door of the electrophotographic copying apparatus. Accordingly, unless the front door is opened, the sub panel 35 can not be operated. A weekly timer set key 36 and a copy volume management set key 37 are provided on the sub panel 36. The weekly timer set key 36 is used for setting times when the power supply of the electrophotographic copying apparatus is turned on and off over one week. For example, from Monday to Friday, the power supply of the electrophotographic copying apparatus is turned on at eight in the morning while being turned off at five in the evening. The copy volume management set key 37 is used for setting or confirming the situation where a copy volume is managed for each department when a plurality of departments use the electrophotographic copying apparatus. When the keys 36 and 37 are operated, the contents set by the key operations are also displayed in the display portion 11.

Figure 2A:
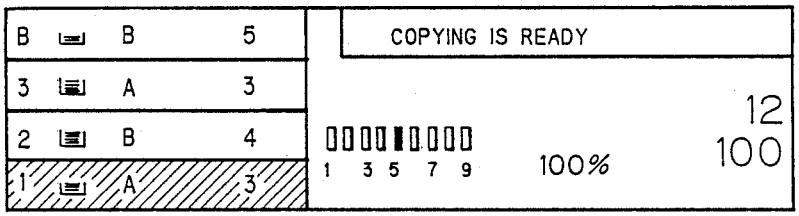
FIGS. 2A, 2B and 2C are diagrams showing examples of the contents displayed in a display portion.

FIG. 2 is a diagram showing a specific example of the contents displayed in the display portion 11. FIG. 2A shows an example of the display of the normal mode. The contents displayed include the display "Copying is ready.", the display of the number of copies "12", the display of a magnification "100% " indicating that an equal size magnification is selected, the display of the copy density and the display of the kind of the selected copy paper, and the like.

Figure 2B:
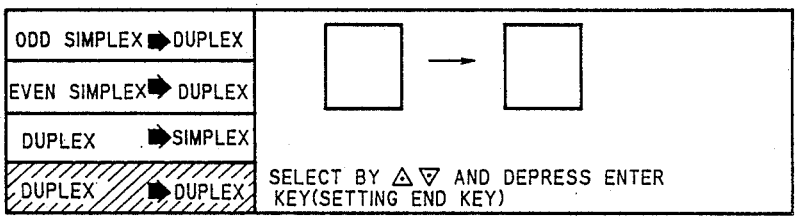
Figure 2C:
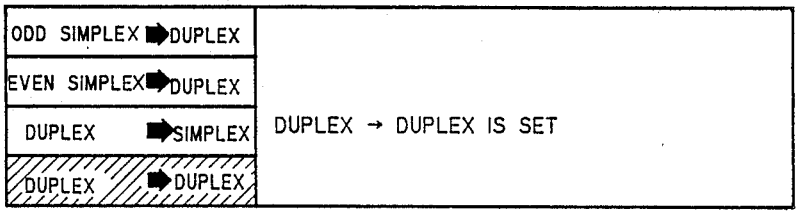

FIG. 2B shows a specific example of the display of the special mode. This display is an example of the display in a case where the duplex copy setting key 22 out of the special mode setting keys is operated. At the time of this display, desired contents are selected from the the contents displayed in the left column by the indication key 33, and the setting end key 32 is depressed. Then, the display in the display portion 11 is changed to the display shown in FIG. 2C. FIG. 2C shows the display indicating that the selected contents, that is, "a duplex to duplex copy mode" is set as an operation mode.

Figure 3:
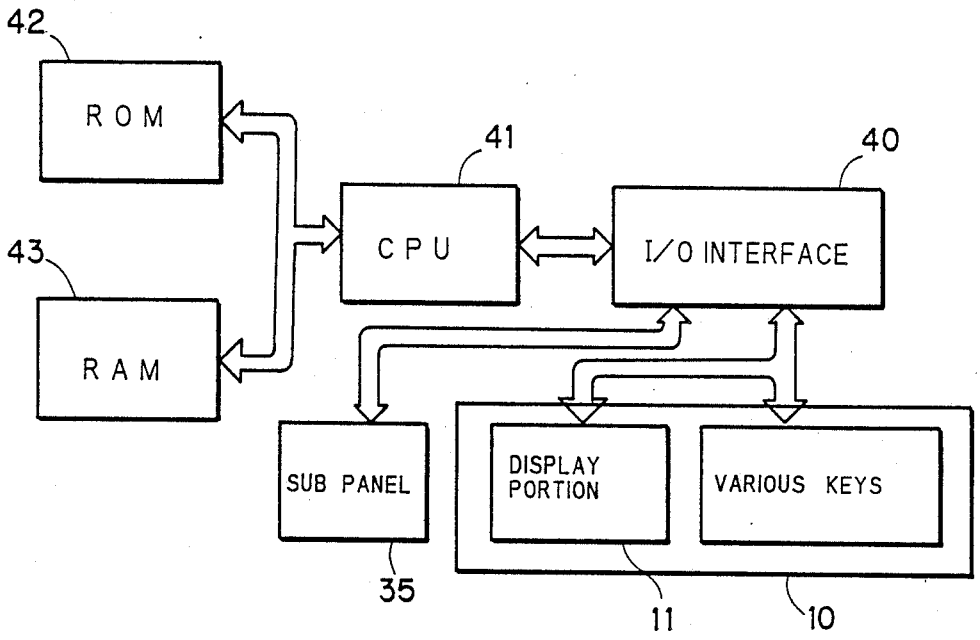
FIG. 3 is a block diagram showing the construction of a control circuit of the display portion.

FIG. 3 is a block diagram showing an example of the construction of a control circuit of the operation panel 10. A display portion 11 and various keys provided on the operation panel 10 are connected to a CPU (central processing unit) 41 through an I/O interface 40. In addition a sub panel 35 is also connected to the CPU 41 through the I/O interface 40. The CPU 41 is connected to a ROM (read only memory) 42 storing operation programs of the CPU 41 and a RAM (random access memory) 43 to and from which data can be written at the time of arithmetic processing and the written data can be read out as required.

Meanwhile, the CPU 41 may only control the operation panel 10 and the sub panel 35 in the electrophotographic copying apparatus. Alternatively, the CPU 41 may simultaneously control other mechanisms of the electrophotographic copying apparatus. In the present embodiment, the latter is employed.

Figure 4:
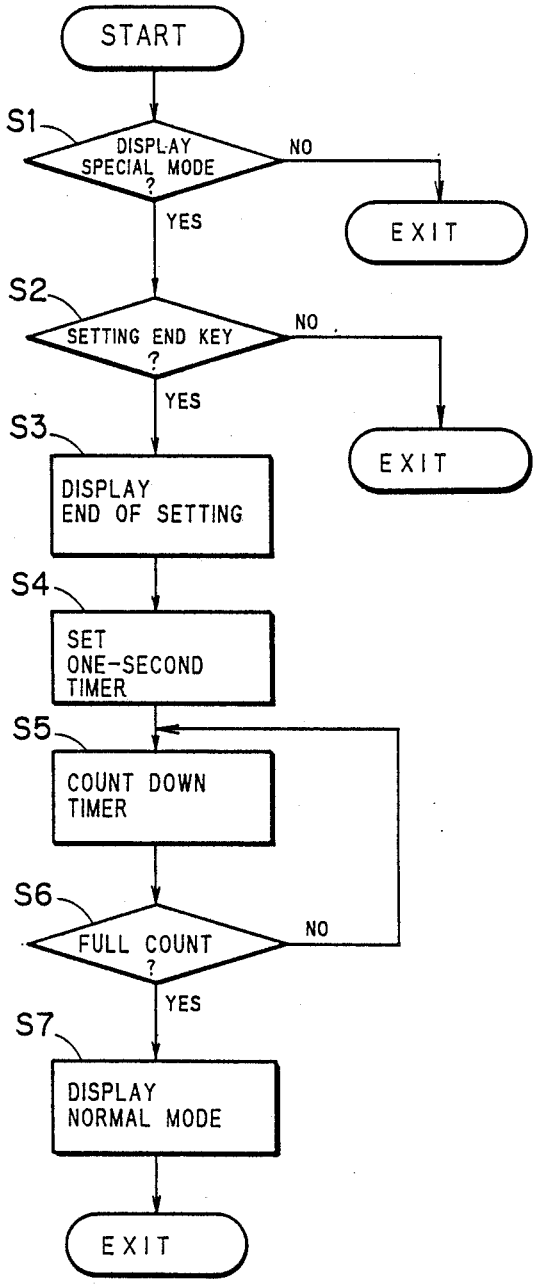
FIG. 4 is a flow chart showing a display control operation of the display portion of the electrophotographic copying apparatus according to an embodiment of the present invention.

FIG. 4 is a flow chart for explaining an operation of the control circuit shown in FIG. 3.

Referring now to FIGS. 1 to 4, description is made of a display control operation of the display portion 11 according to the present embodiment.

The display control operation of the display portion 11 can be carried out by, for example, interruption processing for each constant cycle while the other mechanisms of the electrophotographic copying apparatus are controlled. When the control is started, the CPU 41 determines whether the display mode of the display portion 11 is the normal mode as shown in FIG. 2A or the special mode as shown in FIG. 2B (step S1). If the special mode is displayed, the CPU 41 determines whether or not an input signal is applied from the setting end key 32 out of the special mode setting keys (step S2).

If the input signal is applied from the setting end key 32, the CPU 41 displays the end of setting of the special mode shown in FIG. 2C (step S3), and sets a one-second timer by a soft timer using the RAM 43 (step S4). The set time of this soft timer may be time having a suitable length other than one second. The CPU 41 counts down the soft timer (step S5). In response to the full count of the timer (step S6), the CPU 41 switches the display mode of the display portion 11 to the normal mode as shown in FIG. 2A (step S7).

The display portion 11 is controlled in the above described manner. Accordingly, after the special mode is set, the special mode is automatically switched to the normal mode after a lapse of a constant time period, for example, one second. Consequently the contents of the special mode set are displayed at the time of setting the special mode and then, the operating state of the electrophotographic copying apparatus which a user usually desires to confirm is displayed in the normal mode.

Although in the above described embodiment, description was made of a case in which the display mode of the display portion 11 is switched between the normal mode and the special mode by taking the electrophotographic copying apparatus as an example, the display mode is not limited to the normal mode and the special mode. For example, the display mode may be the other modes.

Furthermore, the present invention is applicable to a facsimile other than the electrophotographic copying apparatus.

Although the present invention has been described and illustrated in detail, it is clearly understood that the same is by way of illustration and example only and is not to be taken by way of limitation, the spirit and scope of the present invention being limited only by the terms of the appended claims.

WHAT IS CLAIMED IS:

1. A display device provided in an image forming apparatus for displaying predetermined data, comprising:

display means capable of selectively displaying a first mode or a second mode and usually displaying the first mode, second mode setting means for setting the second mode, operation mode setting means for setting, when said display means displays the second mode, an operation mode of the image forming apparatus based on the contents of the second mode, and automatic display switching means responsive to an output of said operation mode setting means for automatically switching the display mode of said display means from the second mode to the first mode.

2. The display device according to claim 1, wherein the contents of said first mode displayed comprise the contents required for an image forming operation such as the size of an original, the size of the copy paper used for forming an image, the number of copy sheets used for forming the image, and the density of the image to be formed, and the contents of said second mode displayed comprise the special contents such as the contents for forming an edit image such as masking and trimming and the contents for forming a composite image.

3. The display device according to claim 1, wherein said automatic display switching means switches the display mode after a lapse of a predetermined time period since the output of said operation mode setting means was detected.

4. The display device according to claim 2, wherein said automatic display switching means switches the display mode after a lapse of a predetermined time period since the output of said operation mode setting means was detected.

* * * * *